US009955565B2

(12) United States Patent
Schwoebel

(10) Patent No.: US 9,955,565 B2
(45) Date of Patent: Apr. 24, 2018

(54) HYDROCARBON BASED ION SOURCE

(71) Applicant: SRI International, Menlo Park, CA (US)

(72) Inventor: Paul Schwoebel, Bosque Farms, NM (US)

(73) Assignee: SRI International, Menlo Park, CA (US)

( * ) Notice: Subject to any disclaimer, the term of this patent is extended or adjusted under 35 U.S.C. 154(b) by 1593 days.

(21) Appl. No.: 13/875,276

(22) Filed: May 1, 2013

(65) Prior Publication Data

US 2013/0294556 A1 Nov. 7, 2013

Related U.S. Application Data

(60) Provisional application No. 61/641,385, filed on May 2, 2012.

(51) Int. Cl.

| | |
|---|---|
| ***H05H 6/00*** | (2006.01) |
| ***H05H 3/06*** | (2006.01) |
| ***H01J 33/02*** | (2006.01) |
| ***H05H 1/52*** | (2006.01) |

(52) U.S. Cl.

CPC ..... *H05H 3/06* (2013.01); *H01J 33/02* (2013.01); *H05H 1/52* (2013.01); *H05H 6/00* (2013.01)

(58) Field of Classification Search

CPC .. H05H 3/06; H05H 6/00; H05H 1/52; H01M 43/66; G21B 1/15; G21B 1/19; G21B 1/21

USPC ..... 376/101, 105, 108, 151; 250/269.4, 250/390.01

See application file for complete search history.

(56) References Cited

U.S. PATENT DOCUMENTS 3,417,245 A * 12/1968 Schmidt ..... H05H 3/06 376/109
3,876,521 A * 4/1975 Atkinson ..... C10G 71/00 208/143
4,587,430 A * 5/1986 Adler ..... H01J 27/02 250/423 R

* cited by examiner

*Primary Examiner* — Sharon M Davis
(74) *Attorney, Agent, or Firm* — Ballard Spahr LLP

(57) ABSTRACT

The invention provides methods and apparatus for extracting ions, and further for producing neutrons from the extracted ions. In an aspect, there is provided a method for extracting ions involving the following step: in a vacuum chamber applying voltages to a spark gap between two electrodes comprising coatings of a hydrocarbon, each voltage sufficient to trigger a spark discharge in the gap sufficient to dissociate the hydrocarbon and extract therefrom hydrogen ions, wherein the hydrocarbon is a nonvolatile liquid sufficiently non-viscous to flow and re-coat holes in the coatings between each spark discharge.

20 Claims, No Drawings

HYDROCARBON BASED ION SOURCE

CROSS-REFERENCE TO RELATED APPLICATIONS

This application claims priority to U.S. Ser. No. 61/641,385, filed May 2, 2012, the contents of which are incorporated herein by reference.

BACKGROUND

Neutron generators are required for a wide variety of national and homeland security field-based activities related to nuclear terrorism and nonproliferation. Despite a 2002 National Academy study in which the need for improved compact neutron generators was noted, a compact generator with the required characteristics of neutron output, longevity, robust character, and reasonable cost does not yet exist.

Compact neutron generators are typically of the deuterium-deuterium (DD) or deuterium-tritium (DT) type, and fall broadly into two categories depending on the hydrogen isotope ion source used. The first type uses low-pressure gas discharge-based ion sources, such as a Penning discharge. The second type uses a spark or arc discharge that provide relatively high-output generators with limited lifetimes. The high output is due to the ionization of, for example, deuterium stored at high density in metal deuterides and the significant ion current that can be extracted from what can be ampere-level, high-current density discharges. A factor limiting the lifetime of these sources is erosion of the metal hydride by the electrical spark or arc.

Relevant art: U.S. Pat. Nos. 4,092,381; 4,224,261; 4,252,610.

SUMMARY

The invention provides a method for extracting ions: in a vacuum chamber, applying voltages to a spark gap between two electrodes comprising coatings of a hydrocarbon, each voltage sufficient to trigger a spark discharge in the gap sufficient to dissociate the hydrocarbon and extract therefrom hydrogen ions, wherein the hydrocarbon is a nonvolatile liquid sufficiently non-viscous to flow and re-coat holes in the coatings between each spark discharge.

In embodiments:

the hydrocarbon is deuterated or tritiated;

the ions are deuterium or tritium ions;

the hydrocarbon is an oil;

the hydrocarbon is polar the hydrocarbon has a molecular weight below 1000 g/mol;

the hydrocarbon is selected from: SANTOVAC 5™ [m-Bis(m-phenoxyphenoxy)benzene], PENTAVAC 5™ (polyphenyl ether), 1,3,5-trimethyl-1,1,3,5,5-pentaphenyltrisiloxane, pentaerythritol tetrahexanoate, bis(2-ethylhexyl) azelate;

the method further comprises triggering at least 500 spark discharges in succession without changing the electrodes and without recoating the electrodes with the hydrocarbon;

the spark discharge completely dissociates the hydrocarbon;

the spark gap is between 0.01 and 5 mm;

the repetition rate of applying voltages is in the range of 0.1-1 Hz;

the method comprises activating a capacitor electrically connected to the electrodes to supply the voltages;

the method further comprises coating the electrodes with the hydrocarbon;

the method further comprises reacting the extracted ions with a target in a fusion reaction, producing neutrons; particularly, wherein:

the target comprises a deuterated metal, a metal hydride, or a tritiated metal;

the distance between the electrodes and the target is between 1 and 20 cm; or at least $10^7$ neutrons/second are produced.

In an aspect there is provided a method of producing neutrons, the method comprising extracting ions according to the methods above, and further comprising, prior to the extracting, positioning a target within the vacuum chamber such that at least a portion of the extracted ions react with the target to produce neutrons.

In another aspect, there is provided an apparatus for producing ions, the apparatus comprising a vacuum chamber, a pair of electrodes separated by a spark gap and disposed within the vacuum chamber, and a voltage source configured to apply a voltage to the electrodes sufficient to create a spark discharge therebetween. The electrodes are coated with a hydrocarbon and the spark discharge is sufficient to cause dissociation of the hydrocarbon and extract ions therefrom.

In an embodiment, the apparatus further comprises a target disposed within the vacuum chamber and configured to react with the extracted ions, wherein the reaction produces neutrons.

The invention encompasses all combinations of the particularly recited embodiments; for example, wherein the method: (a) further comprises triggering at least 500 spark discharges in succession without changing the electrodes and without recoating the electrodes with the hydrocarbon, and (b) further comprises reacting the extracted ions with a target in a fusion reaction, producing neutrons.

These and other embodiments will be apparent to the skilled artisan based on the disclosure provided herein, including the examples and claims.

DETAILED DESCRIPTION OF PARTICULAR EMBODIMENTS

In an embodiment, there is provided a method for extracting ions, the method comprising: in a vacuum chamber applying voltages to a spark gap between two electrodes comprising coatings of a hydrocarbon, each voltage sufficient to trigger a spark discharge in the gap sufficient to dissociate the hydrocarbon and extract therefrom hydrogen ions, wherein the hydrocarbon is a nonvolatile liquid sufficiently non-viscous to flow and re-coat holes in the coatings between each spark discharge.

In an aspect, there is provided a method of producing neutrons, the method comprising extracting ions according to the methods herein, and further comprising, prior to the extracting, positioning a target within the vacuum chamber and within 1-20 cm of the electrodes, such that at least a portion of the extracted ions react with the target to produce neutrons.

The disclosed methods involve an apparatus comprising a vacuum chamber, a voltage source, and a pair of electrodes. The apparatus may further comprise a target for generating neutrons. The apparatus may further comprise collimating components suitable for collimating emitted neutrons and/or extracted ions. The apparatus may further comprise sensors and imaging devices suitable for monitoring the method and/or the output of the apparatus.

The methods involve a vacuum chamber. In embodiments, the vacuum chamber is a sealable chamber connected to an active vacuum pump and suitable for housing the electrodes. In embodiments, the vacuum chamber is a sealed vacuum tube with a getter (i.e., a passive vacuum pump) and suitable for housing the electrodes. The chamber may also be configured to house the target, and further optionally configured to house any components for collimating emitted neutrons and/or extracted ions.

The vacuum chamber is capable of attaining reduced pressure suitable for the disclosed methods, and determination of such suitable reduced pressures is within the ordinary level of skill in the art. Examples of suitable reduced pressures are any pressures less than or equal to $5\times10^{-3}$ Torr, include the range of $5\times10^{-3}$-$1\times10^{-8}$ Torr, or $10^{-4}$-$10^{-8}$ Torr, or pressures less than or equal to $10^{-4}$, $10^{-5}$, $10^{-6}$, $10^{-7}$ or $10^{-8}$ Torr. In embodiments, where the vacuum chamber is a sealable chamber, the methods may further involve sealing the chamber and evacuating the chamber to produce the desired vacuum.

The methods involve a pair of electrodes. The electrodes are disposed within the vacuum chamber and are spaced apart by a spark gap (also referred to as a "gap" herein). The size of the gap is the distance that the electrodes are spaced apart and may be within the range of 0.1-5 mm, or 0.3-3 mm, or 0.5-2 mm, or the gap is greater than or equal to 0.1, 0.3, 0.5, or 1 mm, or less than or equal to 3, 2, or 1 mm. The electrodes may be flat, square, or circular in cross section. For example, in embodiments, the electrodes are circular in cross section with a diameter in the range 0.01-0.05 inches, such as greater than or equal to 0.1, 0.2, 0.3, 0.4, or 0.5 inches. In embodiments, the electrode tips are configured to face each other and the area between the tips is the spark gap. In embodiments, the tips are wedge- or cone-shaped to form a sharpened tip. The electrodes may be made of any suitable conductive material, such as metals (e.g. tungsten, copper, tantalum, graphite, etc.) and alloys (e.g., stainless steel, tungsten-copper composite, etc.), or conductive ceramic materials.

The methods involve application of a voltage to the two electrodes, wherein the voltage is sufficient to create a spark discharge between the electrodes. In embodiments, the appropriate voltage is within the range of 1-50 kV, such as 1-25 kV, or 5-15 kV, or may be greater than or equal to 1, 5, 10, 15, 20, 30, or 40 kV, or may be less than or equal to 50, 40, 30, 20, 15, or 10 kV. Lower voltages may be used where commonly known auxiliary methods are used to trigger the spark gap (e.g., a auxiliary electrode(s) used to trigger the main spark discharge, or a tube with a radioactive source that emits electrons for ionizing a gas and triggering the spark discharge, etc.). The appropriate voltage will be dependent upon factors such as the electrode configuration (e.g., the spark gap distance) and the coating hydrocarbon. Determination of suitable voltage for triggering a spark discharge is well within the skill in the art.

The voltage is provided by any suitable voltage source (also referred to herein as a "voltage switch"). In embodiments, the voltage source is a capacitor electrically connected to the electrodes, such as a capacitor in parallel with the gap. The capacitor is of a suitable capacitance to provide the required voltage, and determination of such capacitance is within the skill in the art. The capacitor may be a plurality of capacitors suitable arranged to provide the required voltage. In embodiments, the capacitor is provided in a circuit with other components such as current limiting components (e.g., resistor(s)) and the like.

In the disclosed methods, the electrodes are coated with a hydrocarbon. The hydrocarbon is a non-volatile liquid sufficiently non-viscous to flow and re-coat holes in the coatings between each spark discharge. The hydrocarbon may be water immiscible (i.e., a non-polar oil) or water miscible (i.e. a polar organic liquid). By "non-volatile" is meant that, under the conditions of the disclosed methods (i.e., within the vacuum chamber at reduced pressure), there is substantially no evaporation of the hydrocarbon. For example, in embodiments, non-volatile hydrocarbons have a vapour pressure below 0.000025, or 0.00002, or 0.00001 Pa at 37° C. The hydrocarbon re-coats holes in the electrode coating on the timescale of the method (e.g., after a spark discharge and before a subsequent spark discharge). The hydrocarbon does not encompass gases or plasmas. In embodiments, the hydrocarbon is a non-volatile oil.

The hydrocarbon is an organic compound comprising hydrogen (or an isotope of hydrogen), carbon, and optionally comprising heteroatoms such as the oxygen atoms present in ethers (e.g., polyethers, polyphenylethers, etc.), silicon atoms present in silicone oils, and the like. In an embodiment, the hydrocarbon is a heteroatom-containing aromatic hydrocarbon. In an embodiment, the hydrocarbon is a polyether or polyphenylether. In embodiments, the hydrocarbon is a siloxane.

The hydrocarbon may be $H^1$-containing, D-containing (i.e., deuterated), T-containing (i.e., tritiated), or may contain any combination of $H^1$ with D or T. As used herein, the term "deuterated" includes fully deuterated and partially deuterated compounds, and the term "tritiated" includes fully tritiated and partially tritiated compounds.

In embodiments, the hydrocarbon is not a single compound but rather is a mixture of compounds, such as a mixture of any of the compounds described herein. In embodiments, the hydrocarbon is a low molecular weight organic compound such as a compound having a molecular weight less than or equal to 1000, 750, or 500 g/mol, or within the range of 250-1000, or 500-1000 g/mol. In embodiments, the hydrocarbon is not a solid at room temperature. In embodiments, the hydrocarbon is not a polymer, such as a polymer having a molecular weight greater than 2000, 3000, 5000, or 10000 Da. In embodiments, the hydrocarbon is a polymer (e.g., comprising at least 10, 15, 20, 25, 30, or 50 repeat units, or having a molecular weight of at least 1000, 2000, 3000, or 5000 Da) that remains liquid (and sufficiently non-viscous to flow and recoat holes in the coatings between spark discharges) at room temperature or at the temperature at which the disclosed methods are carried out (i.e., greater than or equal to 23, 25, 30, or 35 degrees).

Examples of suitable hydrocarbons include SANTOVAC 5™ [m-Bis(m-phenoxyphenoxy)benzene; $C_{30}H_{22}O_4$], PENTAVAC 5™ (a polyphenylether), 1,3,5-trimethyl-1,1,3,5,5-pentaphenyltrisiloxane (a silicone diffusion pump fluid), tetramethyl tetraphenyl trisiloxane, dioctyl sebacate, pentaerythritol tetrahexanoate, bis(2-ethylhexyl)azelate, and the like, as well as isotopic versions of the same such as deuterated or tritiated versions. An example of an isotopic hydrocarbon is deuterated SANTOVAC 5™ [~$C_{30}H_{12}D_{10}O_4$]. Other examples are the deuterated lubricating oils disclosed in U.S. Pat. No. 3,876,521, the relevant contents of which are incorporated herein by reference.

The disclosed methods comprise applying voltages to the spark gap between the two electrodes. Each voltage is sufficient to trigger a spark discharge in the gap, and the spark discharge is sufficient to dissociate the hydrocarbon and extract therefrom ions.

In embodiments, prior to applying the voltage, a surface of the electrodes is coated with the hydrocarbon. The coating can be carried out in any appropriate manner, such as by painting or spraying the hydrocarbon onto the electrode surface, or by dipping the electrode into the hydrocarbon. The hydrocarbon can be applied neat (i.e. without solvent) or as a solvent solution using any appropriate solvent (e.g., water, organic solvents, etc.). Where a solvent is used, the electrodes can be dried to remove the solvent after the coating. In some embodiments, the entire surface of each electrode is coated by the hydrocarbon such that there are no exposed surfaces of the electrodes. In embodiments, the electrode surfaces are only partially coated such as at (and around) the tips of the electrodes.

In embodiments, prior to applying the voltage, the vacuum chamber comprising the electrodes is evacuated to provide a reduced-pressure environment suitable for the desired spark discharge and extraction of ions.

The spark discharge is sufficient to dissociate the hydrocarbon coating the electrode and extract therefrom ions. In embodiments, the hydrocarbon is essentially completely dissociated (i.e. fully dissociated or greater than 95, 98, or 99% dissociated) into individual atoms. In embodiments, the hydrocarbon is partially dissociated into a combination of individual atoms and groups of bonded atoms.

The spark discharge is localized to a spot on the surface of each electrode. At that spot, the electrical current from the spark discharge dissociates the hydrocarbon coating the electrode creates a "hole" in the coating (i.e., the coating is partially or completely eliminated to partially or fully expose the underlying electrode surface). After the spark discharge, the hydrocarbon remaining on the electrode flows and partially or fully re-coats the hole area on the electrode. Thus a subsequent spark discharge from the spot on the surface of the electrode is able to dissociate additional hydrocarbon without the need for manual re-coating.

In embodiments, after a spark discharge, the voltage is re-applied to the electrodes to trigger another spark discharge. This process may be repeated any number of times, such as greater than or equal to 10, 50, 100, 300 or 500 times, with each spark discharge (i.e., each "shot") causing extraction of ions. The time between each shot can be selected from the range 0.1-1 seconds or between 0.1-0.5 seconds, or can be greater than or equal to 0.1, or 0.5 seconds, or can be less than or equal to 1, 0.5, or 0.1 seconds. In embodiments, the repetition rate of spark discharges is within the range 1-10 Hz, or the range 2-10 Hz, or greater than 1, 3, 5, or 7 Hz, or less than 10, 7, 5, or 3 Hz. Furthermore, because of the ability of the hydrocarbon to flow and re-coat the electrodes, the process may be repeated as described without the need of manually recoating the electrodes. In this sense, the methods involve self-regeneration of the hydrocarbon-coated electrodes (i.e., the hydrocarbon coating is self-regenerating). In embodiments, the hydrocarbon coating is self-regenerating for greater than 10, 50, 100, 300 or 500 shots. As well as not needing to re-coat the electrodes, the methods also do not require changing of the electrodes between such shots.

The identity of the extracted ions will depend on the identity of the hydrocarbon. A hydrocarbon that comprises hydrogen (i.e., $H_1$) will yield hydrogen ions (i.e., $H^+$). A hydrocarbon that comprises deuterium (i.e., D) will yield deuterium ions (i.e., $D^+$). A hydrocarbon that comprises tritium (i.e., T) will yield tritium ions (i.e., $T^+$). A hydrocarbon that comprises a combination of hydrogen with deuterium, or hydrogen with tritium, or deuterium with tritium, will yield a combination of $H^+$ with $D^+$, or $H^+$ with $T^+$, or $D^+$ with $T^+$, respectively.

In embodiments, the method further comprises reacting the extracted ions with a target in a fusion reaction to produce neutrons. In embodiments, the target is selected from a deuterated metal target, and a tritiated metal target. In embodiments, the target comprises a deuterated metal hydride such as deuterated titanium hydride (TiDH or $TiD_2$), deuterated palladium hydride (PdDH, $PdD_2$), and the like. In embodiments, the target comprises a tritiated metal hydride such as tritiated titanium hydride (TiTH or $TiT_2$), tritiated palladium hydride (PdTH, $PdT_2$), and the like. In embodiments, the target comprises a deuterium/tritium combination hydride such as TiDT, PdDT, or the like.

In embodiments, the target is located within the range of 1-20 cm, or 2-15 cm, or 5-10 cm from the electrodes, or the target is located greater than or equal to 1, 2, 3, 4, or 5 cm from the electrodes or the target is located less than or equal to 20, 15, 10, or 5 cm from the electrodes. The target may be positioned within the vacuum chamber or may be positioned external to the vacuum chamber provided that the extracted ions are able to interact with the target.

Thus, in an aspect, there is provided a method of producing neutrons, the method comprising extracting ions as described herein, and further comprising, prior to the extracting, positioning a target within the vacuum chamber and within 5-10 cm of the electrodes, such that at least a portion of the extracted ions react with the target to produce neutrons.

In embodiments, the disclosed methods involve collimating the extracted ions, collimating the produced neutrons, or collimating both the ions and the neutrons. Collimating can be carried out using known methods and collimating components. In an embodiment, such components are located within the vacuum chamber.

In embodiments, the disclosed methods produce a continuous or pulsed stream of ions. Furthermore, in embodiments, the disclosed methods produce a continuous or pulsed stream of neutrons, with a neutron flux of greater than or equal to $10^7$, $10^8$, $10^9$, $10^{10}$, or $10^{11}$ neutrons/second.

The neutrons produced using the methods and apparatus described herein can be used in any suitable application, including medicinal applications and sensor applications. The disclosed methods and apparatus provide an ion source (i.e., the hydrocarbon) with an improved lifetime (e.g., at least 500 shots) compared with previous ion sources.

In embodiments, the ions produced using the described methods and apparatus are used to produce neutrons as described. In other embodiments, the ions can be used as a proton source (particularly when the hydrocarbon is $H^1$-containing), which could be used in medical applications or the like. The protons themselves can be used, or they can be used to drive other proton-driven nuclear reactions. Protons can be accelerated and used directly for cancer therapy or 'stand-off' detection of nuclear materials. Furthermore, protons can be used to drive neutron producing nuclear reactions such as bombarding lithium-7 containing targets with protons to produce neutrons and beryllium-7, or bombarding tritium containing targets with protons to produce neutrons and helium-3.

It is to be understood that while the invention has been described in conjunction with examples of specific embodiments thereof, that the foregoing description and the examples that follow are intended to illustrate and not limit the scope of the invention. It will be understood by those skilled in the art that various changes may be made and equivalents may be substituted without departing from the scope of the invention, and further that other aspects, advantages and modifications will be apparent to those skilled in the art to which the invention pertains. Any combination of the embodiments described herein is intended to be part of the invention, as if all such combinations had been laboriously set forth in this disclosure.

Examples

The experimental chamber was a turbomolecular-pumped high vacuum chamber operating in the $10^{-7}$ Torr range within 30 minutes of evacuation from atmospheric pressure. The spark ion source consisted of two 0.02" diameter W electrodes ground to a wedge shape and placed with the axes of rotational symmetry aligned with one another. The electrode separation forming the spark gap was ~1 mm. Voltage was applied to the spark gap using Behlke 331-06 high voltage switch. Typically voltages of ~12 kV were applied to reliably trigger the spark gap. A 2.7 nF capacitor was placed in parallel with the electrodes, and a group of three 1 kΩ resistors that are in parallel with each other was placed (as a group) in series with the electrodes. The capacitor acted as a voltage source and the resistors as a current limiter. The voltage and current across the spark gap was measured using, respectively, a Tektronix model 6015 high voltage probe and a Stangenes Industries Model 2—0.1 WA current transformer. The current on the target was monitored with a Stangenes Model 2—1.0 W current transformer.

The fluids used to coat the W electrodes were SANTOVAC 5™ [m-Bis(m-phenoxyphenoxy)benzene; $C_{30}H_{22}O_4$], and a deuterated version of SANTOVAC 5™ [~$C_{30}H_{12}D_{10}O_4$], diffusion pump fluids. The fluids were outgassed in high vacuum, then vented to nitrogen and manually applied to the W electrodes. Good coating was evident by a visible contact angle of much less than 90° between the fluid and the W electrodes.

Mass analysis was conducted using a custom 90°, 7 cm radius electrostatic energy analyzer followed by a 1.2 meter time-of-flight mass spectrometer. The energy analyser is used as the ion energy spread in the spark source is on the order of 1000 eV. The ion detector on the time of flight system was a 3" chevron CEMA. The electron output of the CEMA was projected onto a P-47 phosphor screen and viewed with a Photonis XP2262B photomultiplier tube.

Neutron production measurements were made using a laboratory neutron generator consisting of a high vacuum chamber in which the deuterated metal target and spark ion source were placed in a diode-geometry. The target to source separation was relatively large (~10 cm). The target was $TiD_2$ and operated at between −65 kV relative the grounded electrode of the spark ion source. The plastic scintillator detector used for neutron detection was 2 cm in thickness, 800 cm in length and 200 cm in height. The associated PMT was a Hamamatsu R329-02. The scintillator-PMT combination produces ~20 meV high signals (−1500 V on PMT) that have a FWHM of ~6 ns on the Compton Edge of a $Co^{60}$ source. This nearly 1 MeV gamma-ray is roughly equivalent to the signal produced by the 2.5 MeV neutrons produced by the DD fusion reaction. The neutron detector was place 2 m from the target and it output viewed directly with a Tektronix TDS 540D oscilloscope. The wax used as the neutron attenuator/moderator was Texaco Texwax paraffin.

Results

The mass spectrum obtained from commercial and deuterated SANTOVAC 5™ were obtained. In the case of SANTOVAC 5™, the dominant peaks in the mass spectra were always H+ and C+. The intensity of the C+ peak was almost always much less than that of the H+ peak. The essentially complete dissociation of the hydrocarbon species is not surprising and is part of the reason that spark sources, particularly of the energetic form employing a parallel capacitor, are not used for the study of hydrocarbons. The appearance of hydrogen and carbon peaks was consistent throughout the energy ranges selected with the electrostatic analyzer from ~50 V to 1000 V—ranges outside of which individual mass peaks were no longer observed. To zeroth order the mass spectra did not change significantly over the range studied with the energy analyzer. Over 100+ discharges other mass species were occasionally seen, but the H+ and C+ peak intensities remained dominant and relatively constant.

Mass spectra were obtained when partially deuterated oil was used to coat the electrode surfaces. The conditions (spark voltage, detector gains, analyzer deflection voltages) under which the mass spectra were collected are identical to those used previously for commercial and deuterated SANTOVAC 5™. It is clear that now both H+ and D+ appear in the spectrum indicating again the dissociation of the hydrogen component of the molecule into atoms.

The spark gap coated with deuterated fluid was also operated in the laboratory neutron generator. Spark gap current, target current, and resulting neutron pulse versus time were measured. The zero of time was set by triggering on of the negative going signal of the spark-gap voltage due to initiation of the spark discharge. No attempt was made to initiate a sustained arc, and thus for these studies the spark gap current upon initiation of the discharge showed a time dependence that reflected the RC time constant of the electrical arrangement. Under the electrical circuit conditions used here, the target current typically peaked at ~0.6 A, which of course includes secondary electron current, as no attempt was made to suppress such emission. The total charge delivered to the target is ~4 μC/2=2 μC using the fact that at 65 keV there is roughly 1 secondary electron per incident H or D ion. The neutron signal is clearly the result of pulse pile-up in the detector. Assuming the current reflects the mass spectra and that carbon is a small component, then to zeroth order ~½ of the current is $D^+$ and the remaining half $H^+$, Thus ~1 μC of $D^+$ was delivered to the target, which should produce ~$10^5$ neutrons. As most of these neutrons arrive in the detector within ~10 μs, the neutron rate is estimated to be $10^{10}$ neutrons/s, well beyond the ~$10^8$ neutron/s count rate of the detector.

To verify the observed signals were due to neutrons, neutron production experiments were repeated with and without placing a wall of 12" of Texwax paraffin between the target and the detector to prevent line of site neutron flight from the target to the detector. The target current and neutron signal with and without intervening wax were measured. After placing the 12" thick wax barrier between the detector and target, the second set of were data taken. The detector signal was reduced significantly due to the presence of the wax, consistent with the detector signal being due only to neutrons. After removal of the wax barrier a third set of data was accumulated. This experiment demonstrates that the detector signal observed is due to the DD neutrons produced by the source.

Neutron production experiments such as those described here have been conducted for >500 shots without changing the electrodes or recoating with oil: the oil reflows to replenish the material removed during the discharge.

What is claimed is:

1. A method for extracting ions, the method comprising: in a vacuum chamber applying voltages to a spark gap between two electrodes comprising coatings of a hydrocarbon, each voltage sufficient to trigger a spark discharge in the gap sufficient to dissociate the hydrocarbon and extract therefrom hydrogen ions, wherein the hydrocarbon is a nonvolatile liquid sufficiently non-viscous to flow and re-coat holes in the coatings between each spark discharge.

2. The method of claim 1, wherein the hydrocarbon is deuterated or tritiated, and the ions are deuterium or tritium ions.

3. The method of claim 1, wherein the hydrocarbon is deuterated or tritiated and is heteroatom-containing and aromatic, and the ions are deuterium or tritium ions.

4. The method of claim 1, wherein the hydrocarbon is deuterated or tritiated and is an oil, is polar or has a molecular weight below 1000 g/mol.

5. The method of claim 1, wherein the hydrocarbon is deuterated or tritiated and is selected from: m-Bis(m-phenoxyphenoxy)benzene, polyphenyl ether, 1,3,5-trimethyl-1,1,3,5,5-pentaphenyltrisiloxane, tetramethyl tetraphenyl trisiloxane, dioctyl sebacate, pentaerythritol tetrahexanoate, and bis(2-ethylhexyl)azelate.

6. The method of claim 1, comprising triggering at least 500 spark discharges in succession without changing the electrodes and without recoating the electrodes with the hydrocarbon.

7. The method of claim 1, wherein the spark discharge completely dissociates the hydrocarbon.

8. The method of claim 1, wherein the method comprises activating a capacitor electrically connected to the electrodes to supply the voltages.

9. The method of claim 1, further comprising coating the electrodes with the hydrocarbon.

10. The method of claim 1, further comprising reacting the extracted ions with a target in a fusion reaction, producing neutrons.

11. The method of claim 1, further comprising reacting the extracted ions with a target in a fusion reaction, producing neutrons, wherein the target comprises a deuterated metal or a tritiated metal.

12. The method of claim 1, further comprising reacting the extracted ions with a target in a fusion reaction, producing neutrons, wherein the target comprises a deuterated metal or a tritiated metal, and the distance between the electrodes and the target is between 1 and 20 cm.

13. The method of claim 1, wherein the hydrocarbon is an oil.

14. The method of claim 1, wherein the voltages are applied with a repetition rate of in the range of 0.1-1 Hz.

15. The method of claim 1, further comprising coating the electrodes with the hydrocarbon, and further comprising reacting the extracted ions with a target in a fusion reaction, producing neutrons.

16. The method of claim 1, comprising triggering at least 500 spark discharges in succession without changing the electrodes and without recoating the electrodes with the hydrocarbon, and further comprising reacting the extracted ions with a target in a fusion reaction, producing neutrons.

17. The method of claim 1, further comprising reacting the extracted ions with a target in a fusion reaction, producing at least $10^7$ neutrons/second.

18. The method of claim 1, wherein the spark gap is between 0.01 and 5 mm.

19. A method of producing neutrons, the method comprising extracting ions according to the method of claim 1, and further comprising, prior to the extracting, positioning a target within the vacuum chamber and within 1-20 cm of the electrodes, such that at least a portion of the extracted ions react with the target to produce neutrons.

20. The method of claim 19, wherein the target is selected from a deuterated metal target and a tritiated metal target.

* * * * *